US006551259B1

(12) United States Patent
Wu

(10) Patent No.: US 6,551,259 B1
(45) Date of Patent: Apr. 22, 2003

(54) RECIPROCALLY MOVING APPARATUS FOR DRIVING MASSAGE DEVICE

(76) Inventor: Dong-Her Wu, No.141, Sec.2, Chang-Shui Road, Pu-Yen Hsiang, Chang-Hua Hsien (TW)

( * ) Notice: Subject to any disclaimer, the term of this patent is extended or adjusted under 35 U.S.C. 154(b) by 0 days.

(21) Appl. No.: 09/598,900

(22) Filed: Jun. 22, 2000

(51) Int. Cl.[7] ..... A61H 7/00

(52) U.S. Cl. ..... 601/99; 601/98; 601/101; 601/103; 601/115; 601/116; 601/122

(58) Field of Search ..... 601/97, 98, 99, 601/100, 101, 102, 103, 115, 116, 122, 126

(56) References Cited

U.S. PATENT DOCUMENTS 2,827,044 A * 3/1958 Orthwine ..... 128/33
5,437,609 A * 8/1995 Leonard et al. ..... 601/91
5,462,516 A * 10/1995 Anderson ..... 601/99
6,224,563 B1 * 5/2001 Nonoue et al. ..... 601/99

* cited by examiner

*Primary Examiner*—Nicholas D. Lucchesi
*Assistant Examiner*—Quang D. Thanh

(57) ABSTRACT

A reciprocally moving apparatus used in a massage machine comprises a long driven shaft having two ends pivotably installed in a base plate and also inserted into a sleeve hole at the lower side of a bottom mount of a massage device. The center section of the driven shaft includes a clockwise helical trench and a counter-clockwise helical trench which are arranged along a surface of the driven shaft and are crossed over one another alternatively and the ends of the two trenches are connected. The upper side of the center section area of the bottom mount serves for installing a cylindrical active link block having a guide plate. The guide plate has two tips at the upper side and inserts into one of the two tracks. Therefore, the driven shaft can be driven to move along the trenches reciprocally.

1 Claim, 7 Drawing Sheets

FIG3-A

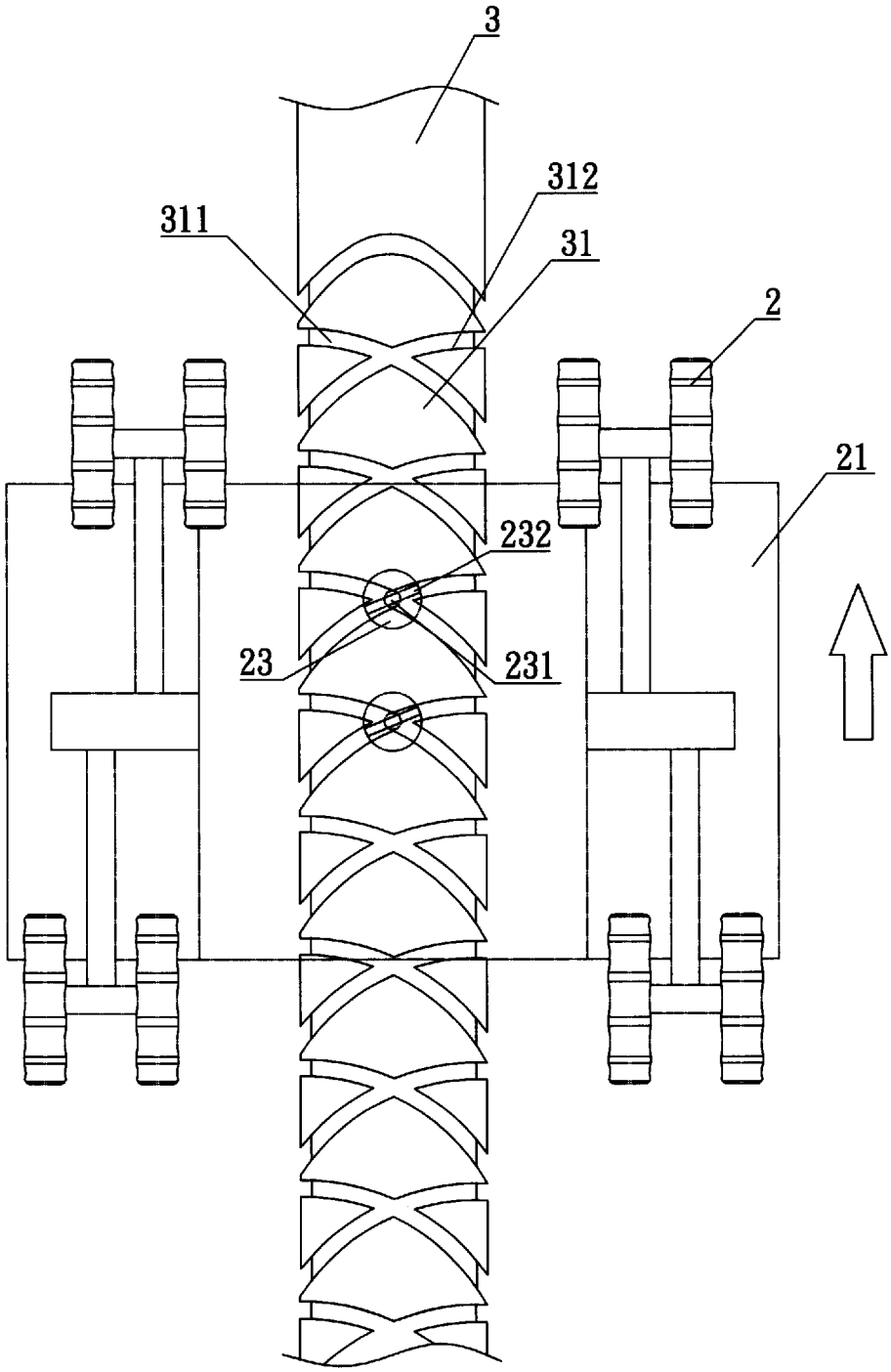
FIG4-A

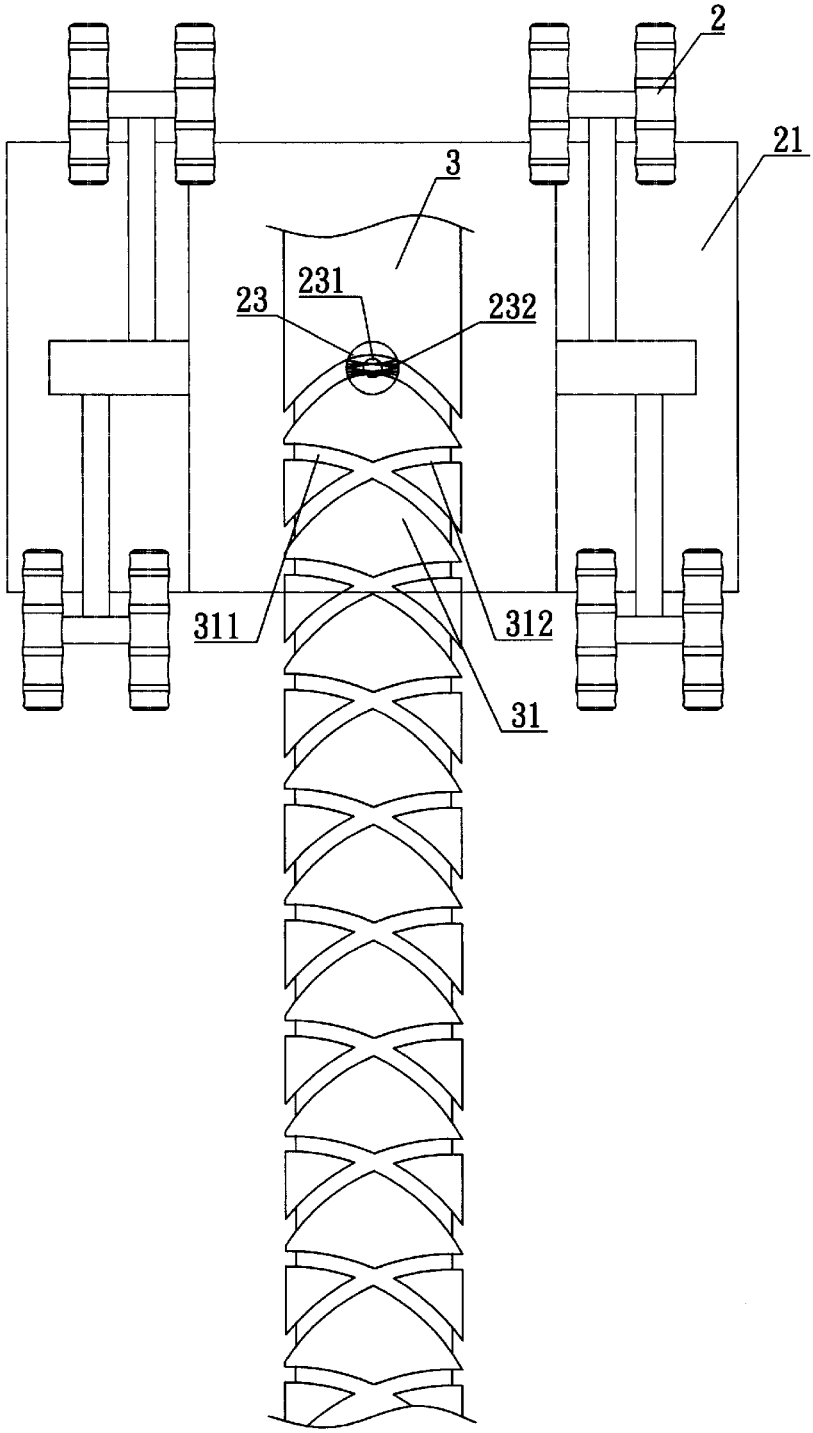
FIG4-B

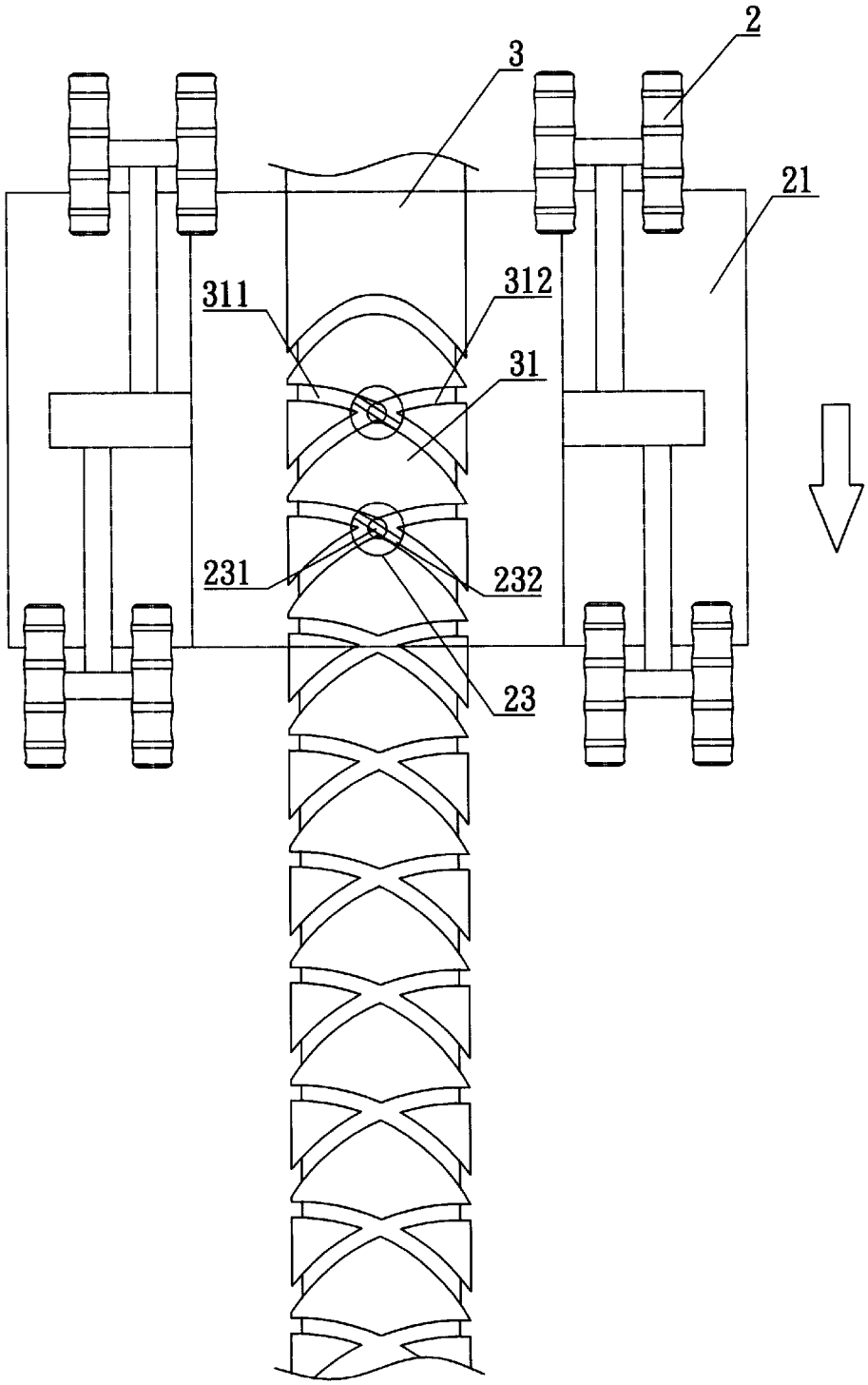
FIG4-C

RECIPROCALLY MOVING APPARATUS FOR DRIVING MASSAGE DEVICE

BACKGROUND OF THE INVENTION

1) Field of the Invention

The present invention relates to massage devices, and particularly to a driven structure which moves continuously and reciprocally and is utilized at the back section of a massage chairs or in the interior of a pillow.

2) Description of the Prior Art

Since conventional massage devices installed on chairs or the interior sections of pillows for massaging back of a user must be capable of massaging the entire surface area of the back, they must move reciprocally and vertically to the back of the user. The reciprocating moving device of such conventional massage driving structures includes a single direction rotational rod, belt, chain, or other related means as well as a motor-based forward and backward rotation massage structure capable of performing a straight reciprocal motion.

However, since the prior art device needs a complicated drive structure that impels a pair of shafts to rotate, this will increase production cost and installation space. Therefore, there are manufacturing and utilization complexity and thus the prior art is not practical.

Another individually driven single rotary-direction device has a rotary shaft impelled by a direct current motor or an alternating current motor in which each of the two extremities of the reciprocating driven shaft must be equipped with an actuating control device which enable the rotational direction of the motor to be reversed each time the shaft contacts the distal ends, thereby, switching the driven shaft to rotate clockwise or counter-clockwise and to carry the massage device to move forward and then reverse the move direction backward to other end of travel. Although such a method compromises the production cost and space occupied, each time the moving directions of the driven shaft is switched during operation, it is impossible to avoid to generate transient current which will be applied to the motor so as to induce a fluctuating current, resulting in short random noises indicating high torque loads that shorten the lifetime of the motor. In situations of frequent utilization, since the back section of the massage device moves continuously and reciprocally, such condition causes the motors of such devices to malfunction or burn out and then require to be repaired or updated by a new one.

SUMMARY OF THE INVENTION

The primary objective of the present invention is to provide a reciprocally moving apparatus, wherein a single long driven shaft between two shaft blocks on a base plate is installed. The middle section of the driven shaft includes a clockwise helical trench and a counter-clockwise helical trench which are arranged on the surface of the driven shaft and cross over one another alternatively so as to be formed as a rod with two crossed helical trenches. A recess is formed in an upper side of a central area of the massage device for installing an active link block. A mounting lock cover covers on the recess and a cotter hole is formed in a top center section of the mounting lock cover for being inserted by an axial pin at a top end of the active link block, enabling to hold the active link block within the recess. Moreover. A guide plate with two tips at two upper edges is extended from a lower end of the active link block. The guide plate is inserted into one of the clockwise helical trench and the counter-clockwise helical trench.

Another objective of the present invention is to provide a reciprocally moving apparatus, wherein due to a single driven shaft and a rotational driving operation, reciprocal movement of a massage device can be achieved without any actuating control device to be installed at two distal ends of the driven shaft for controlling reversal of the positive and negative polarities without needing to control the electrical current of a driving motor. Therefore, in addition to have a simplified device and circuitry, since there is no positive and negative polarity alternation, a large electrical current will not be generated.

Another object of the present invention is to provide a reciprocally moving apparatus, wherein a single direction driving mode is performed. In this mode, the transmission relationship of the gears between the motor and the driven shaft is suspended. An upper and an lower sections of respective teeth sections of the gears each engaged to the front end motor shaft of the motor are transferred via driven gear at a distal end of the driven shaft and an engager which is a single direction clutch. After a user selects to input a current with a reverse polarity, the motor drives the shaft in the reverse direction such that the driven shaft forms a driving-separation relationship. In this moment, the massage device is not carried and moved, it stops at the original position for the fixed-point massage operation.

The structure, unique features, functions, and practical objectives of the present invention are further elaborated in the brief description of the drawings below followed by the detailed description of the invention.

BRIEF DESCRIPTION OF THE DRAWINGS

FIG. 3-A is an enlarged view showing two trenches of FIG. 3.

FIG. 4-A is an enlarged view showing two trenches of FIG. 3, which especially shows the reverse movement of the massage device.

FIG. 4-B is an enlarged view showing two trenches FIG. 4-A, which especially shows the reverse movement of the massage device.

FIG. 4-C is another enlarged view illustrating the massage device reverse movement depicted in FIG. 3-A.

DETAILED DESCRIPTION OF THE INVENTION

Figure 1:
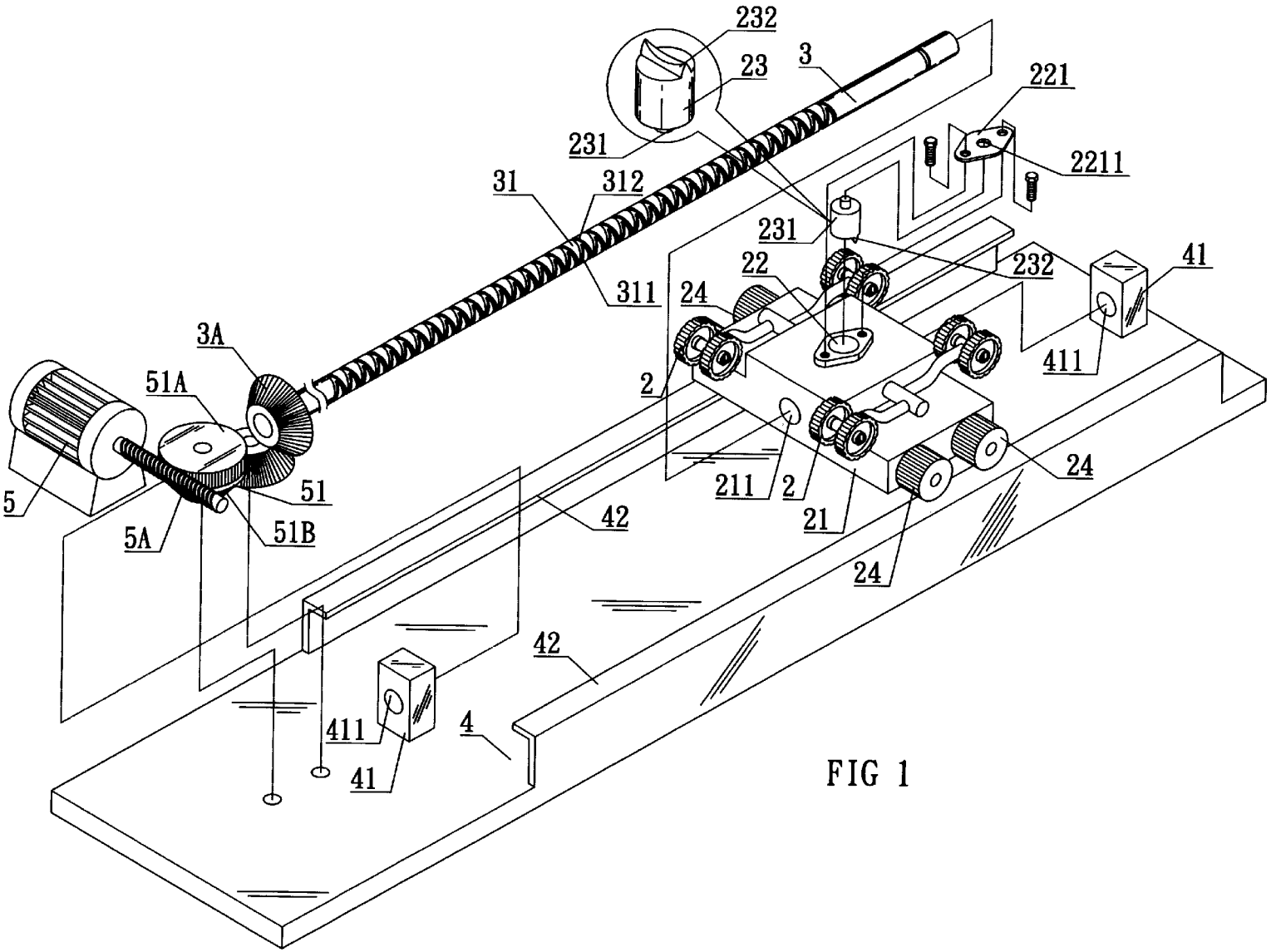
FIG. 1 is an exploded view of the present invention.
Figure 2:
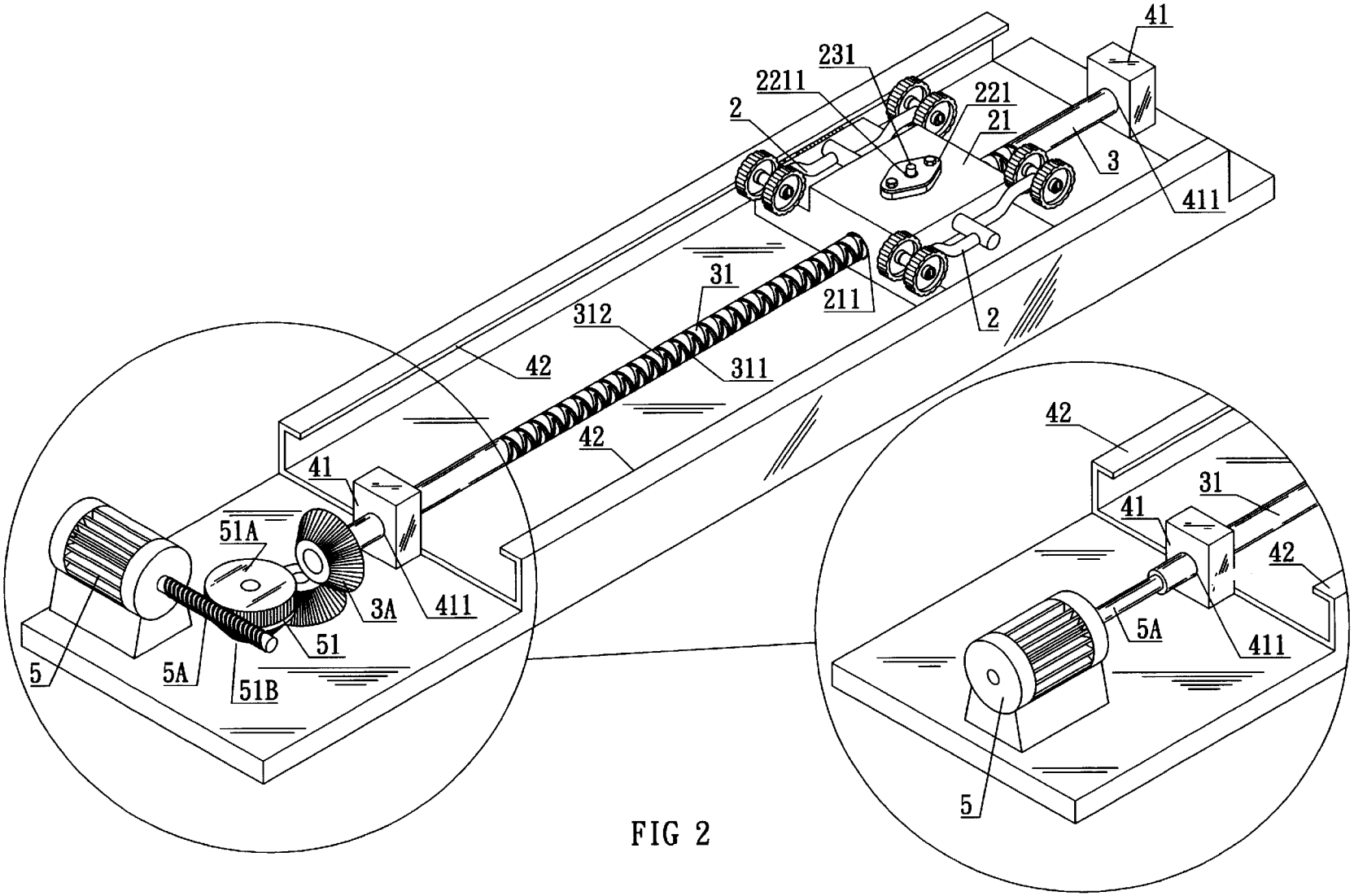
FIG. 2 is a perspective view of the present invention with a part being enlarged.
Figure 3:
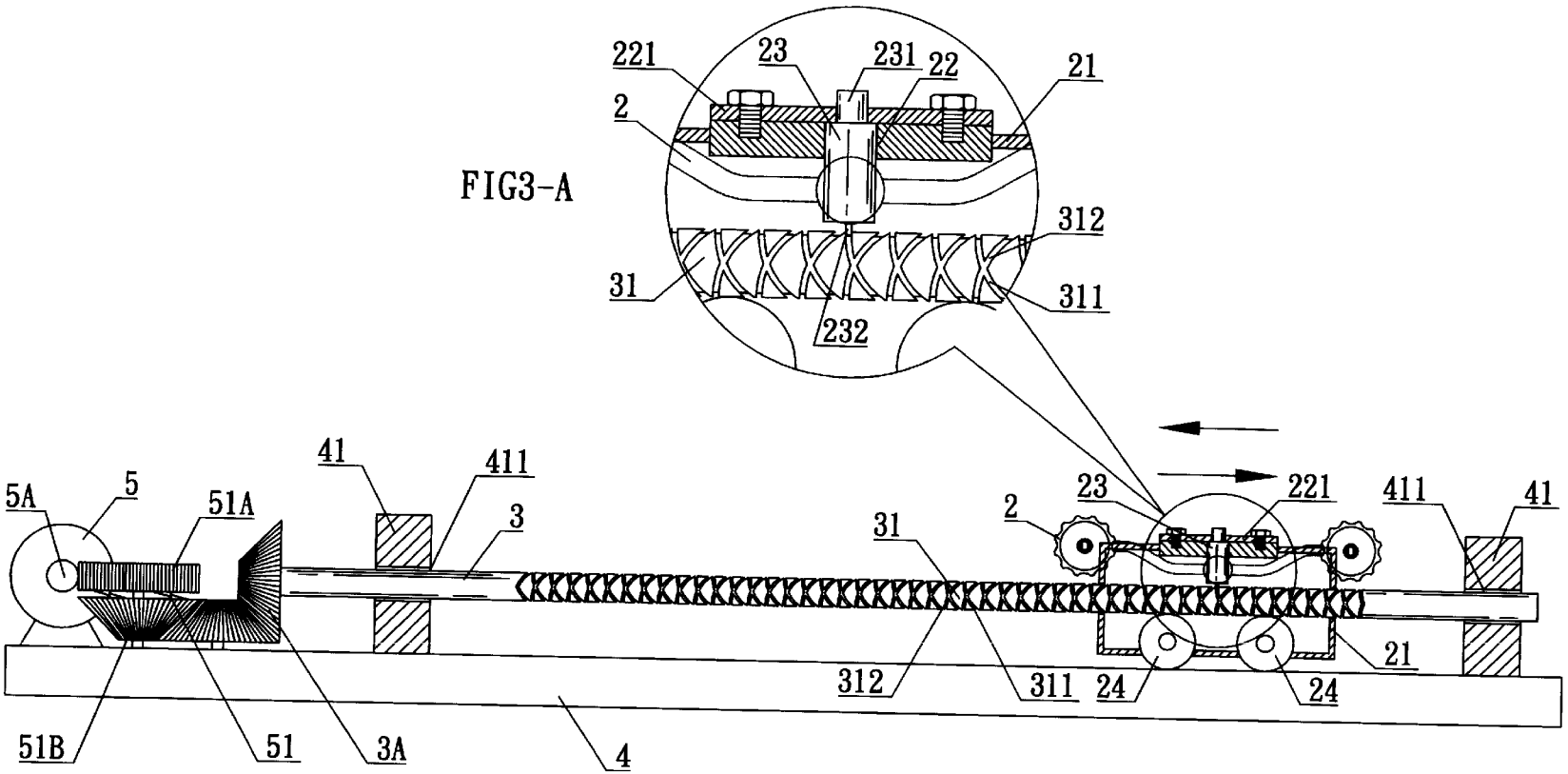
FIG. 3 is a cross-sectional view of the present invention with a part being enlarged.

Referring to FIGS. 1, 2, 3, and 3-A, the present invention discloses a reciprocally moving apparatus installed at the rear section of a massage chairs or in the interior of a pillow that is utilized to massage the back of a user by enabling the continuous motion as well as reciprocal motion along a single axial direction of any massage device 2 (the structure of the massage device 2 is not limited, furthermore, is identical those used in the prior art. Thus, the details will not be described herein). A drive structure of the present invention includes two shaft blocks 41 disposed at two ends of a base plate 4 for pivotally installing the two ends of a long driven shaft 3 to seat holes 411; and the driven shaft 3 is also inserted through the center section of a sleeve hole 211 at the lower extent of a bottom mount 21. A massage device 2 is installed over the center section of the driven shaft 3.

The middle section of the driven shaft 3 between the two shaft blocks 41 includes a clockwise helical trench 311 and a counter-clockwise helical trench 312 which are arranged along the surface of the driven shaft and are crossed over one another alternatively, and the ends of the two trenches are connected as illustrated in FIG. 3-A. so as to be formed as rod 31 with two crossed helical trenches. A recess 22 is formed in the upper side of the central area of the massage device for installing a cylindrical active link block 23. Furthermore, a mounting lock cover 221 covers on the recess 22 and a cotter hole 2211 is formed in the top center section of a mounting lock cover 221 for being inserted by an axial pin 231 at the top end of the active link block 23, enabling to hold the active link block 23 within the interior of the recess 22. Moreover, a guide plate 232 with two tips at two upper edges is extended from the lower end of the active link block 23. The guide plate 232 is inserted downwards into one of the clockwise slide tracking groove 311 and the counter-clockwise slide tracking groove 312.

Referring to FIGS. 3-A, 4-A, 4-B, 4-C, in the structure, the driven shaft 3 is directly rotated or indirectly rotated in a predetermined rotationally driven direction by a motor 5 at the rear side (the two gears in the drawings illustrate an indirectly driven arrangement). The rod 31 is driven to rotate continuously along a predetermined direction. Therefore, since the guide plate 232 inserting in the clockwise helical trench 311 or counter-clockwise helical trench 312 is forced to move along the trench. The bottom mount 21 of the massage device 2 equipped with other components at its top surface is carried continuously forward (as shown in FIG. 4-A) or continuously backward (as shown in FIG. 4-C) in an axial direction. Moreover, since the two ends of the clockwise helical trench 311 and the counterclockwise helical trench 312 of the rod 31 are arranged along the cylindrical rod and cross over one another, at the end of moving path, the guide plate 232 is directed towards an opposite direction (transferred from the clockwise helical trench 311 to the counterclockwise helical trench 312, or from the counter-clockwise helical trench 312 to the clockwise helical trench 311, as shown in FIG. 4-B). After automatically alternating the axial movement direction, the bottom mount 21 is carried with the movement of the guide plate 232 so as to move back and forth along the rod 31 (as the continuous travel shown in FIG. 1-A, FIG. 1-B, and FIG. 1-C; or, that shown in FIG. 1-C to FIG. 1-B and FIG. 1-A).

The structure cause that the single driven shaft 3 has a simplified operation that does not require electric current supply directional switching or other component . Thereby, the driven shaft 3 carries the massage device 2 to move in an axial direction across the back of the user and along entire sections in a reciprocal travel massage action continuously and repeatedly. As a result, the massage device 2 can be automatically operated effectively .

Additionally, when the user desires to massage at a selected area which must stop the operation during the reciprocal movement of the massage device 2 (referring to FIG. 1, FIG. 2, and FIG. 5), the transmission relationship of the gears between the motor 5 and the driven shaft 3 is suspended, a "single direction" driving application is additionally used. The upper and lower sections of the respective teeth sections of the gears each engaged to the front end motor shaft 5A of the motor 5 are transferred via the driven teeth 3A at one distal end of the driven shaft near the motor and an engager 51 (a single direction clutch in which the counter-clockwise direction is disengaged during clockwise driven rotation or the clockwise direction is disengaged during counter-clockwise driven rotation; since this structure is conventionally utilized at the front end of motor shafts, it will not be further described here and is only used to briefly illustrate the present invention with no further description of structure thereof) at the front end of the driven shaft 3.

Therefore, before the user selects to input a current for revering the polarity of the motor, the motor 5 rotates in a single direction such that the driven shaft 3 operates as previously described to carry the massage device 2 to run across the back of the user in whole section so as to reciprocally move (as indicated by the invisible line at the upper section of the engager 51A engaged with the lower section engager 51B which constitutes a state of transmission engagement.).

Figure 5:
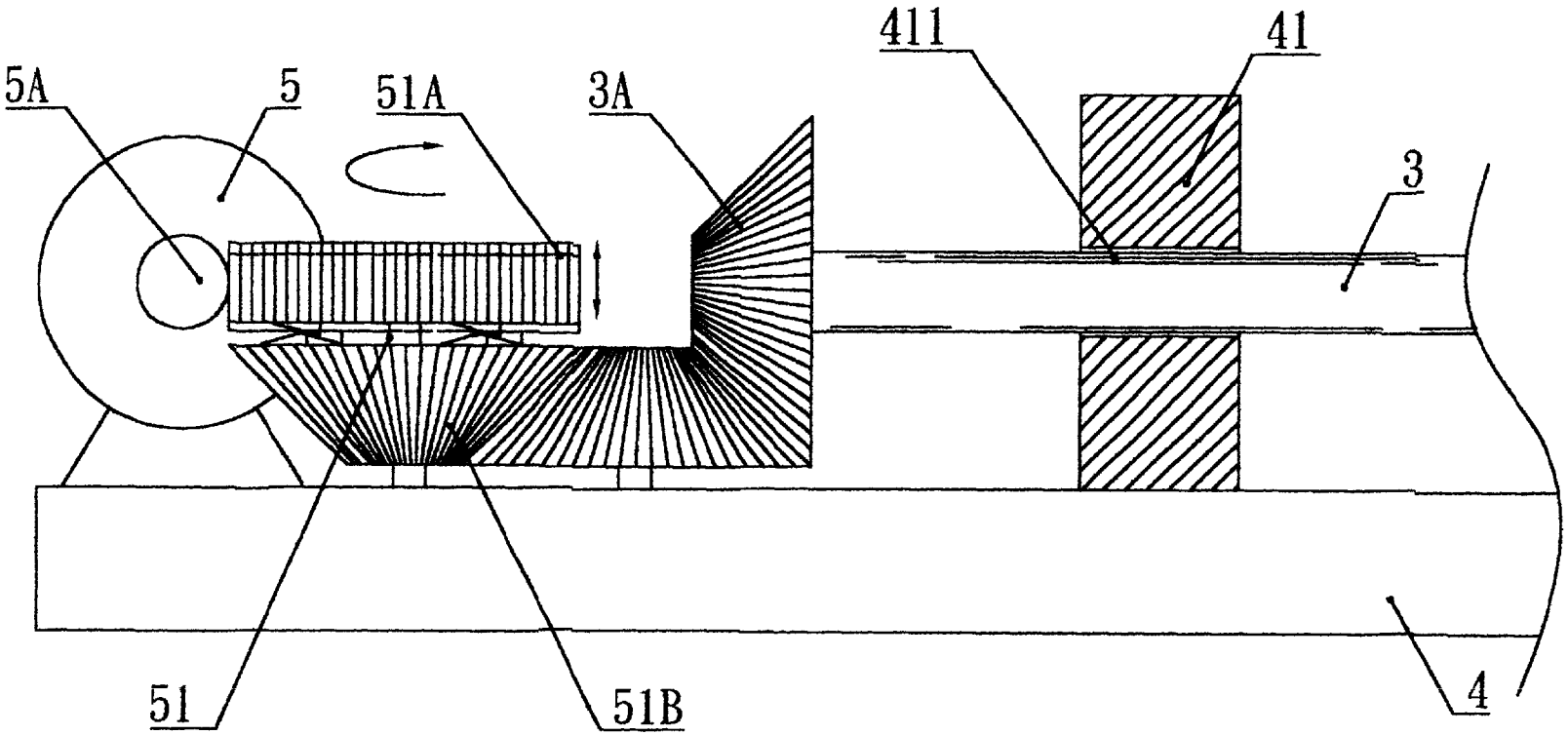
FIG. 5 is a perspective view of the present invention showing a fixed-point massage embodiment.

After the user selects to input a current with a reverse polarity(for example, by adding a "fixed-point" selection button on the operating panel and connecting a reverse polarity electric current operating circuit), the motor 5 can drive the shaft in the reverse direction such that the driven shaft 3 is not driven (as shown by 51A which is indicated by the solid line in FIG. 5, 51A which is not engaged with the lower section engager 51B and forms a separation that precludes a transmission state). Moreover, since the massage device 2 remains stationary because it is not carried and moved, it is stopped at the original position for the fixed-point massage operation. Therefore, this provides various operation modes to the massage devices. Thus, the present invention has the advantages of simple structure and easy operation.

In addition, the present invention provides a stable movement to effectively assist the massage device 2 during the reciprocal movement by installing fixed axle roller 24 at the sides and lower side of the bottom mount 21 which is received in the moving position within a recessed position-limiting channel 42 (as indicated in FIG. 1, FIG. 2, and FIG. 3) disposed in the top surface of the base plate 4. This functions as a restrictive retaining structure that enables the reciprocal motion of the massage device 2 to be effectively stabilized without drifting or swaying towards the left and right sides.

What is claimed is:

1. A reciprocally moving apparatus used in a massage machine comprising a base plate with two shaft blocks disposed at two ends thereof, respectively, with each shaft block has a seat hole, a driven shaft having two ends each installed at respective seat hole of a respective shaft block; a massage device having a bottom mount with a sleeve hole therein; wherein the driven shaft passes through the sleeve hole; characterized in that:

a middle section of the driven shaft between the two shaft blocks includes a clockwise helical trench and a counterclockwise helical trench which are arranged along a surface of the driven shaft and are crossed over one another alternatively and ends of the two trenches are connected; thereby, a section of the driven shaft having the clockwise spiral-like trench and counter-clockwise spiral-like trench are formed as a rod section with two crossed helical trenches; a recess is formed in an upper side of a central area of the massage device for installing an active link block; furthermore, a mounting lock cover covers on the recess and a cotter hole is formed in a top center section of the mounting lock cover for being inserted by an axial pin at a top end of the active link block, enabling to hold the active link block within the recess; moreover, a guide plate with two tips at two upper edges is extended from a lower end of the active link block; the guide plate is inserted into one of the clockwise helical trench and the counter-clockwise helical trench;

a motor for driving the driven shaft through at least one gear to couple the motor and the driven shaft;

an engager is engaged to a motor shaft of a motor and one of gears engaged with the driven shaft, and the engager is acted as a clutch, when the engager is actuated, the power of the motor is transferred to the driven shaft and when the engager is not actuated, the power of the motor will not transfer to the driven shaft and thus the driven shaft is not driven; and a plurality of fixed axle rollers is installed at a lower side of the bottom mount which is received in the travel position within two recessed position-limiting channels disposed in a top surface of the base plate; this functions as a restrictive retaining structure that enables a reciprocal motion of the massage device to be effectively stabilized without drifting or swaying towards the left and right sides;

wherein the driven shaft is indirectly rotated in a predetermined rotationally driven direction by a motor near the distal end of said driven shaft; the driven shaft and the motor are engaged through a plurality of gears; the rod is driven to rotate continuously along a predetermined direction; therefore, since the guide plate inserting in one of the clockwise helical trench and counterclockwise helical trench is forced to move along the trench; the bottom mount of the massage device is carried continuously forward or continuously backward in an axial direction; moreover, since the two ends of the clockwise helical trench and the counterclockwise helical trench of the rod are arranged along the cylindrical rod and cross over one another, at the end of traveling path, the guide plate is directed towards an opposite direction at the end of the rod section; after automatically alternating the axial movement direction, the bottom mount is carried with the movement of the guide plate so as to move back and forth along the rod; the structure cause a simplified operation that does not require power actuating directional switch or other component; thereby, the driven shaft carries the massage device to move in an axial direction across the back of the user and along entire sections in a reciprocal travel massage action continuously and repeatedly; as a result, the massage device is be automatically operated effectively; and wherein a single direction driving mode is performed; in this mode, the transmission relationship of the gears between the motor and the driven shaft is suspended; the engager is not actuated and thus no power of the motor will be transferred to the driven shaft and thus the shaft is not driven; therefore, when a user selects to input a current with a reverse polarity, the motor drives the shaft in the reverse direction such that the driven shaft is not driven; in this moment the massage device is not carried and moved, it is stopped at the original position for the fixed-point massage operation.

* * * * *